US005203469A

United States Patent [19]

Chang et al.

[11] Patent Number: 5,203,469

[45] Date of Patent: Apr. 20, 1993

[54] TOOL BOX

[76] Inventors: Roger Chang; John Lynn, both of 58, Ma Yuan West St., Taichung, Taiwan

[21] Appl. No.: 890,726

[22] Filed: Jun. 1, 1992

[51] Int. Cl.[5] ..... B65D 43/12

[52] U.S. Cl. ..... 220/331; 220/555; 206/372; 206/378

[58] Field of Search ..... 220/555, 331, 332, 333; 206/372, 373, 375, 376, 377, 378, 425, 444

[56] References Cited

U.S. PATENT DOCUMENTS

| | | | |
|---|---|---|---|
| 391,145 | 10/1888 | Hardin | 220/331 |
| 1,997,043 | 4/1935 | Clark | 220/333 |
| 2,357,214 | 8/1944 | McDole | 220/212 |
| 2,979,223 | 4/1961 | Rideout | 220/331 |
| 4,396,119 | 8/1983 | Giulie | 220/332 |
| 4,420,079 | 12/1983 | Gliniorz et al. | 220/331 |
| 4,697,704 | 10/1987 | Curry | 220/212 |
| 4,889,257 | 12/1989 | Steffes | 220/331 |
| 4,927,021 | 5/1990 | Taylor | 220/555 |
| 5,082,631 | 1/1992 | Lenmark, Sr. et al. | 220/331 |

FOREIGN PATENT DOCUMENTS

| | | | |
|---|---|---|---|
| 2001542 | 9/1969 | France | 220/331 |

*Primary Examiner*—Allan N. Shoap
*Assistant Examiner*—S. Castellano

[57] ABSTRACT

A tool box including a body having two side surfaces, a depression, a slot and a groove formed in one end of each of the side surfaces, the slot inclined from the depression to a middle and upper portion of the body, the groove extended vertically from the depression to the bottom portion of the body, and a cover including a pair of flanges each having a stub formed integral on one end for engagement with the depressions of the body, whereby, the stubs are slidable along either the slots or the grooves.

2 Claims, 4 Drawing Sheets

TOOL BOX

BACKGROUND OF THE INVENTION (a) Field of the Invention

The present invention relates to a tool box, and more particularly to a tool box for accommodating tools such as screw driver, wrenches, sockets etc.

(b) Description of the Prior Art

Typical tool boxes comprise two parts pivotally coupled together, the two parts can not be easily disengaged from each other, such that, when the tool box is disposed in a drawer, the upper part can not be fully opened, thereby, the tools accommodated within the tool box can not be easily fetched. The tool box should be taken out from the drawer such that the tools can be fetched.

The present invention has arisen to mitigate and/or obviate the afore-described disadvantages of the conventional tool boxes.

SUMMARY OF THE INVENTION

The primary objective of the present invention is to provide a tool box including a cover which can be easily engaged to and disengaged from the body of the tool box such that the tools can be easily reached.

In accordance with one aspect of the present invention, there is provided a tool box comprising a body including a plurality of recesses formed therein for accommodating tools and including two side surfaces each having a first end and a second end, a depression formed in the first end of each of the side surfaces of the body, a slot inclined from the depression to a middle and upper portion of each of the side surface of the body, and a cover including a pair of flanges extended downward from two side portions thereof respectively, each of the flanges including a stub formed integral on one end thereof for engagement with the depressions of the body such that the cover is rotatable about the stubs, whereby, the stubs are slidable along the slots in order to move the cover along a direction from the depressions toward the second ends of the side surfaces of the body.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
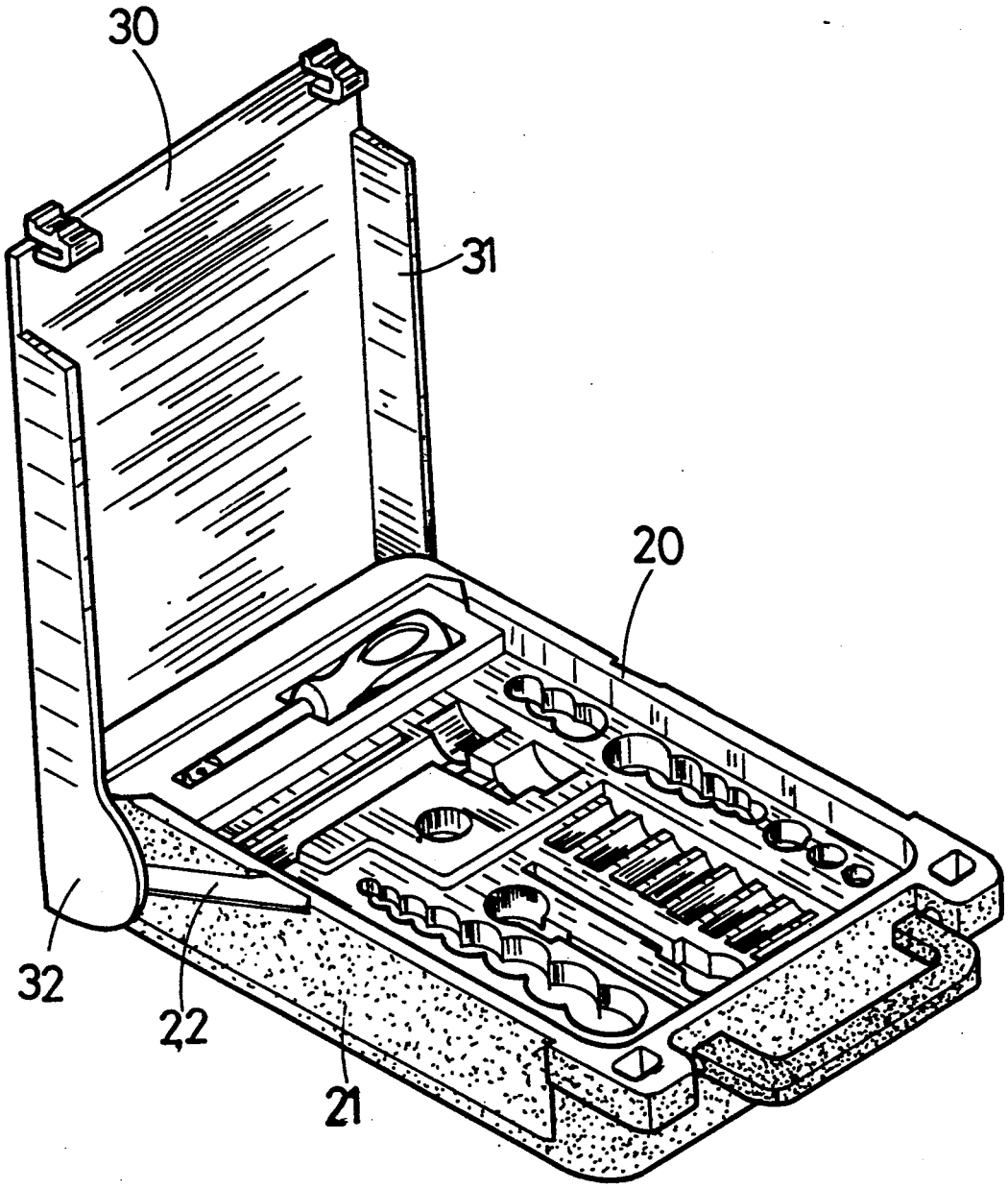
FIG. 1 is a perspective view of a tool box in accordance with the present invention, in which the cover is opened.
Figure 2:
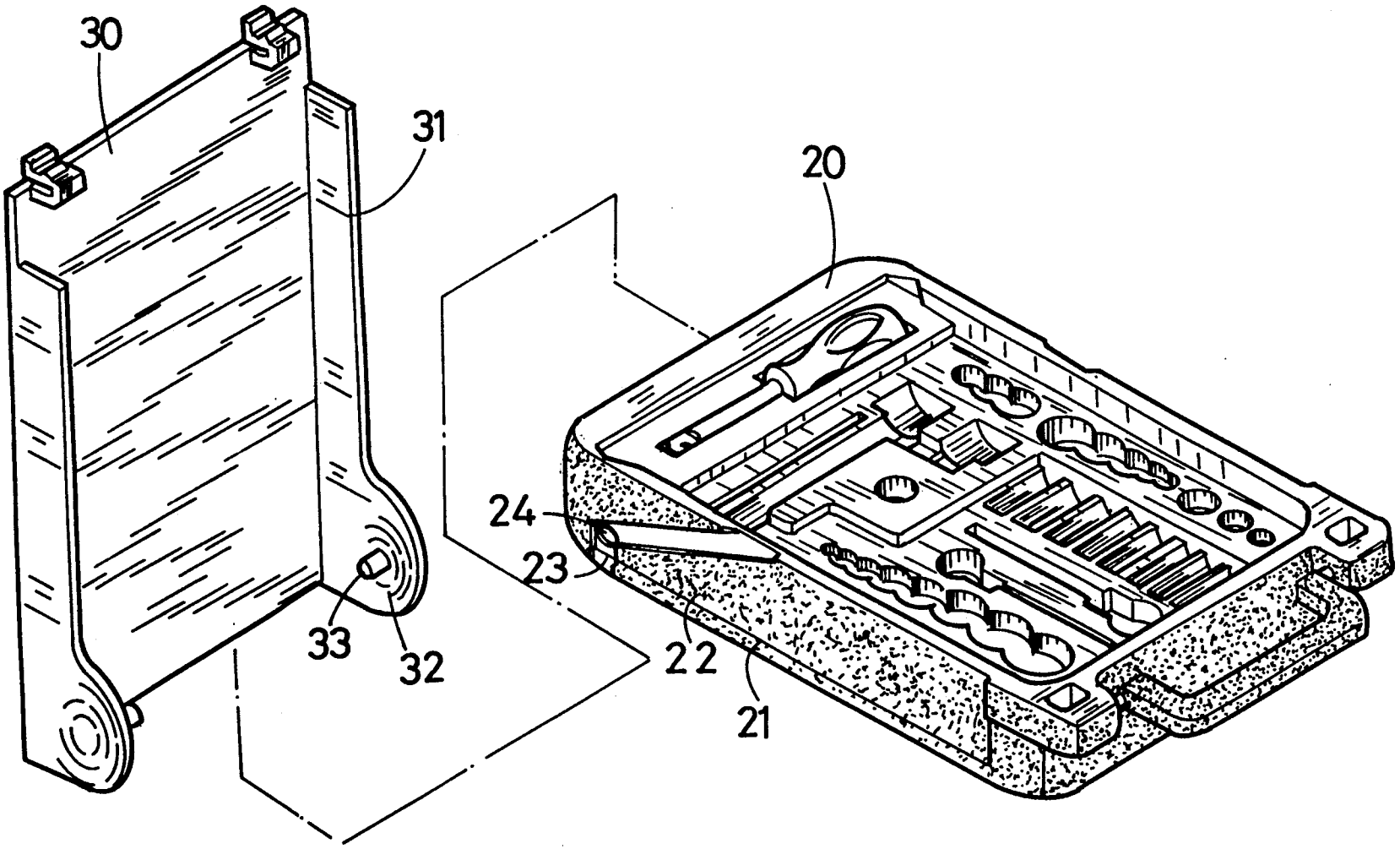
FIG. 2 is an exploded view of the tool box.

Referring to the drawings and initially to FIGS. 1 and 2, a tool box in accordance with the present invention comprises generally a body 20 including an open top and a plurality of recesses and cavities formed therein for accommodating tools, and a cover 30 pivotally coupled to the body 20.

The body 20 includes two side surfaces 21 each having an inclined slot 22 and a vertical groove 23 formed in a first end thereof and intersected at a depression 24. The inclined slot 22 is inclined from the depression 24 toward the second end of the respective side surface 21 of the body and upward toward the open top portion of the body 20, such that the inclined slot 22 includes a first end, i.e. the depression 24, and a second end close to the middle and upper portion of the side surface 21.

The cover 30 includes a pair of flanges 31 extended downward therefrom, the flanges 31 are resilient such that the flanges 31 may expand or extend outwards when the flanges 31 are engaged to the body, each of the flanges 31 includes a lug 32 formed on one end thereof and having a stub 33 formed integral thereon. The stubs 33 may be engaged in the depressions 24 either when the stubs 33 are forced into the second ends of the inclined slots 22 or when the stubs 33 are forced into the lower ends of the vertical grooves 23. The cover 30 is rotatable about the stubs 33 when the stubs 33 are engaged in the depressions 24. It is preferable that the slot 22 and the groove 23 have a slope from the free ends thereof towards the intersection, i.e. the depression 24, such that the stubs 33 can be easily engaged into the slots 22 and the grooves 23.

Figure 3:
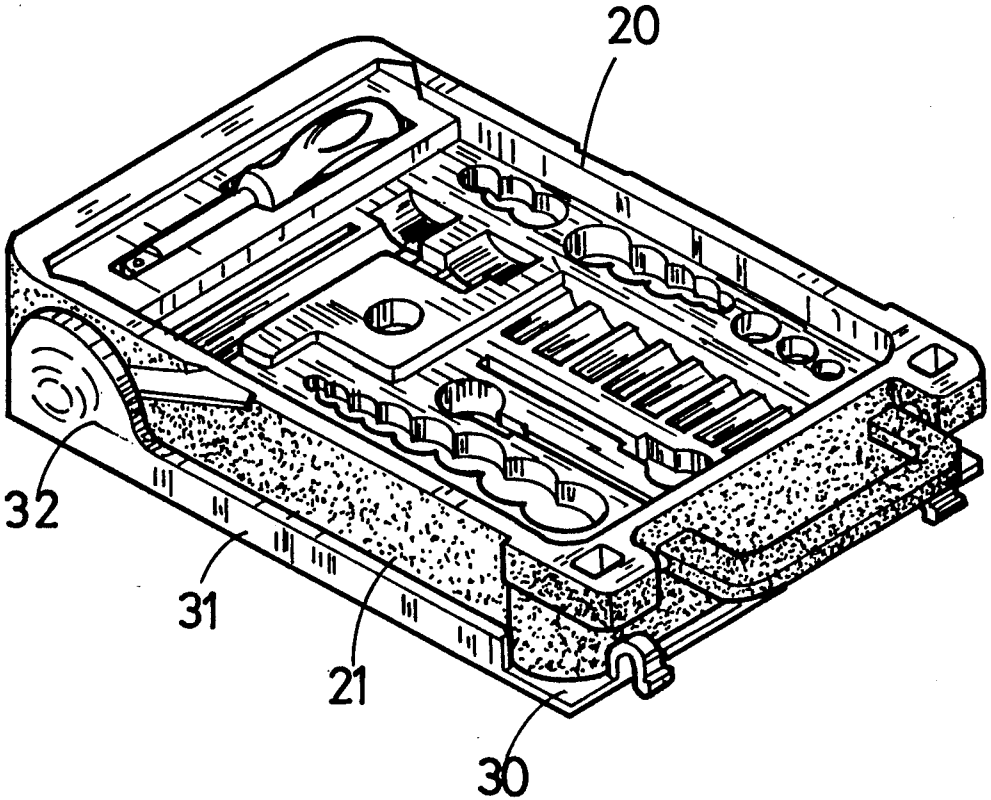
FIG. 3 is a perspective view of the tool box, in which the cover is engaged on the bottom of the body of the tool box.
Figure 4:
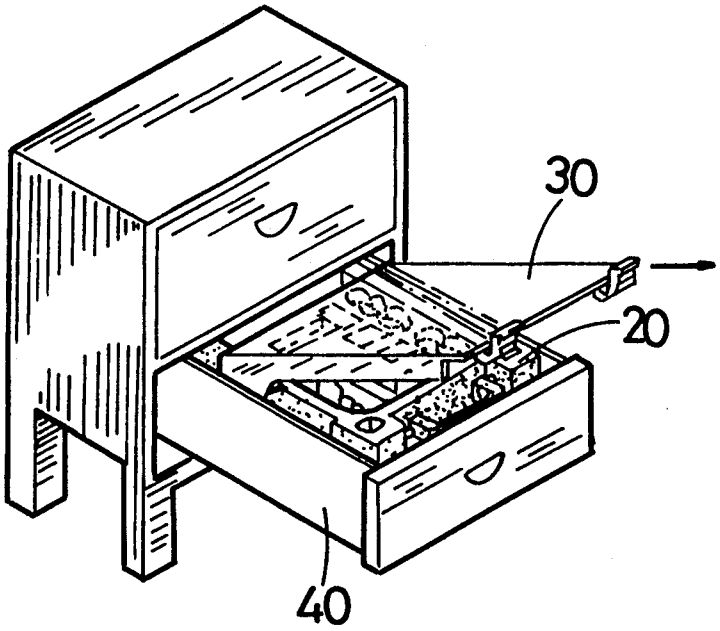
FIG. 4 is a perspective view of the tool box which is disposed in a drawer.

In operation, as shown in FIG. 3, the stubs 33 can be engaged in the depressions 24 from the grooves 23 such that the cover 30 can be engaged in the bottom of the body 20 and such that the tools accommodated in the body 20 can be easily fetched when the tool box is disposed in a drawer; or, as shown in FIG. 4, when the stubs 33 of the cover 30 are engaged in the depressions 24 via the slots 22 and when the tool box is disposed in the drawer 40, the stubs 33 can be caused to slide along the inclined slots 22, such that the cover 30 can be pulled outward, i.e. along a direction from the first end toward the second end of the side surfaces, and such that the cover 30 can be fully opened, or such that the cover 30 can be easily disengaged from the body 20 without taking the tool box out of the drawer.

Accordingly, the tool box in accordance with the present invention includes a cover which can be easily engaged to and disengaged from the body of the tool box such that the tools can be easily reached.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool box comprising a body including a plurality of recesses formed therein for accommodating tools and including two side surfaces each having a first end and a second end, a depression formed in said first end of each of said side surfaces of said body, a slot inclined from said depression to a middle and upper portion of each of said side surface of said body, and a cover including a pair of flanges extended downward from two side portions thereof respectively, each of said flanges including a stub formed integral on one end thereof for engagement with said depressions of said body such that said cover is rotatable about said stubs, each of said side surfaces of said body including a groove formed therein and extended vertically from said depression toward a bottom portion of said body, whereby, said cover is engageable in said bottom portion of said body when said studs are engaged in said depressions via said grooves, and said studs are slidable along said slots in order to move said cover along a direction from said depressions toward said second ends of said side surfaces of said body.

2. A tool box comprising a body including a plurality of recesses formed therein for accommodating tools and including two side surfaces each having a first end and a second end, a depression formed in said first end of each of said side surfaces of said body, a slot and a groove formed in said first end of each of said side surfaces and intersected at said depressions, said slot inclined from said depression to a middle and upper portion of said body, said groove extended vertically from said depression toward a bottom portion of said body, and a cover including a pair of flanges extended downward from two side portions thereof respectively, each of said flanges including a stub formed integral on one end thereof for engagement with said depressions of said body such that said cover is rotatable about said stubs, whereby, said stubs are slidable along said slots in order to move said cover along a direction from said depressions toward said second ends of said side surfaces of said body; and said cover is engageable in said bottom portion of said body when said stubs are engaged in said depressions via said grooves.

* * * * *